US006703085B2

(12) United States Patent
Nakamura

(10) Patent No.: US 6,703,085 B2
(45) Date of Patent: Mar. 9, 2004

(54) INK JET RECORDING SHEET

(75) Inventor: Atsushi Nakamura, Shizuoka (JP)

(73) Assignee: Nisshinbo Industries, Ltd., Tokyo (JP)

( * ) Notice: Subject to any disclaimer, the term of this patent is extended or adjusted under 35 U.S.C. 154(b) by 0 days.

(21) Appl. No.: 10/073,341

(22) Filed: Feb. 13, 2002

(65) Prior Publication Data

US 2002/0155258 A1 Oct. 24, 2002

(30) Foreign Application Priority Data

Feb. 16, 2001 (JP) ..... 2001-040000

(51) Int. Cl.[7] ..... B41M 5/00
(52) U.S. Cl. ..... 428/32.1; 428/32.24; 428/32.38
(58) Field of Search ..... 428/195, 500, 428/521, 522, 32.1, 32.24, 32.38

(56) References Cited

U.S. PATENT DOCUMENTS 5,670,448 A * 9/1997 Kometani ..... 503/227
5,847,738 A * 12/1998 Tutt et al. ..... 347/101
5,984,468 A * 11/1999 Malhotra ..... 347/102
6,001,165 A * 12/1999 Shibuya et al. ..... 106/287.17
6,068,733 A * 5/2000 Storbeck et al. ..... 162/135
6,251,824 B1 * 6/2001 Ueno et al. ..... 503/227
6,294,243 B1 * 9/2001 Nakamura ..... 428/195
6,300,045 B2 * 10/2001 Lobo et al. ..... 430/496
6,465,078 B1 * 10/2002 Kawai et al. ..... 428/195
6,558,740 B1 * 5/2003 Santo et al. ..... 427/146

* cited by examiner

*Primary Examiner*—Cynthia H. Kelly
*Assistant Examiner*—B. Shewareged
(74) *Attorney, Agent, or Firm*—Armstrong, Kratz, Quintos, Hanson & Brooks, LLP

(57) ABSTRACT

To present an ink jet recording sheet excellent not only in the image quality right after printing by oil-based ink, but also in fading preventive effect when printed by oil-based ink. An ink jet recording sheet forming an ink receiving layer on a base material, in which the ink receiving layer contains at least one of chlorinated polypropylene, compound of chlorinated polypropylene, versatic acid vinyl ester, and compound of versatic acid vinyl ester.

18 Claims, No Drawings

INK JET RECORDING SHEET

BACKGROUND OF THE INVENTION

1. Field of the Invention

The present invention relates to an ink jet recording sheet forming an ink receiving layer on a base material, and more particularly to an ink jet recording sheet excellent in fading preventive effect when printed in an oil-based ink.

2. Description of the Related Art

As one of printing methods, the ink jet recording method is rapidly expanding its application owing to its advantages such as reproduction of full-color image of high picture quality and low running cost. In the ink jet recording method, hitherto, water-based ink has been used, but recently oil-based ink is used more increasingly. The water-based ink is an ink of which solvent is water or a solvent having a high affinity for water, and the oil-based ink is an ink of which solvent is mainly a petroleum high boiling point solvent. The oil-based ink is used more increasingly because it is noticed that the printed image has a higher weather resistance.

Incidentally, when the oil-based ink is printed on an ink jet recording sheet suited to the conventional water-based ink, the absorption of ink solvent is inferior, and flow of image and other problems occur. Therefore, the ink jet recording sheet is required to have a high applicability to the oil-based ink.

Various materials have been proposed so far as ink jet recording sheets suitable to the oil-based ink. For example, Japanese Laid-open Patent No. 11-165460 proposes an invention of an ink jet recording sheet forming an intermediate layer and an ink receiving layer on a base material, in which the intermediate layer contains a resin which dissolves or swells in a petroleum high boiling point solvent.

The recording sheet proposed by this invention is an excellent ink jet recording sheet for the oil-based ink because the intermediate layer absorbs the solvent of the oil-based ink. However, recently, as the requirements for image are diversified as a result of expansion of application of ink jet recording system, even in the case of using the oil-based ink, there is an increasing demand for ink jet recording sheet less in fading after lapse of time, in addition to the image quality right after printing. This demand cannot be sufficiently satisfied by the conventional ink jet recording sheet for the oil-based ink.

In the light of the problems of the conventional ink jet recording sheet for the oil-based ink, it is an object of the invention to present an ink jet recording sheet excellent not only in the image quality right after printing, but also in fading preventive effect when printed in the oil-based ink.

SUMMARY OF THE INVENTION

To solve the problems, the invention presents an ink jet recording sheet forming an ink receiving layer on a base material, in which the ink receiving layer contains at least one of chlorinated polypropylene, compound of chlorinated polypropylene, versatic acid vinyl ester, and compound of versatic acid vinyl ester.

In the configuration of the invention, preferably, the ink receiving layer may contain a resin which does not dissolve or swell in a petroleum high boiling point solvent in an oil-based ink. Preferably, an intermediate layer containing a resin capable of absorbing and holding a petroleum high boiling point solvent in an oil-based ink may be provided between the ink receiving layer and the base material, and such resin is a resin which swells in the solvent, or swells and then dissolves therein.

Explaining the point of notice by the inventor of the present invention, the present inventor intensively studied, and discovered that an excellent fading preventive effect is obtained by containing the following substances in the ink receiving layer, in the ink jet recording sheet forming a porous ink receiving layer on a base material. That is, such substance is one of chlorinated polypropylene, compound of chlorinated polypropylene, versatic acid vinyl ester, and compound of versatic acid vinyl ester. The reasons of exhibiting the fading preventive effect are estimated as follows. First, these substances are excellent in performance of fixing coloring material in the ink. Therefore, after printing, it is expected to suppress the phenomenon of the coloring material in the ink sinking in the direction of the base material. Second, these substances are very large in the property of swelling in the petroleum high boiling point solvent or swelling and dissolving therein. Accordingly, when printed, these substances are swell or dissolve in the petroleum high boiling point solvent in the ink, and the pores in the ink receiving layer are filled up, thereby suppressing passing and sinking of the coloring material in the ink through pores.

DESCRIPTION OF THE PREFERRED EMBODIMENTS

Embodiments of ink jet recording sheet of the invention are explained.

The recording sheet of the invention is composed of an ink receiving layer formed on a base material as described below, and further an intermediate layer may be provided between the base material and ink receiving layer.

The ink receiving layer of the invention contains at least one of chlorinated polypropylene, compound of chlorinated polypropylene, versatic acid vinyl ester, and compound of versatic acid vinyl ester. Among these substances, denatured chlorinated polypropylene and vinyl acetate-ethylene-versatic acid vinyl ester copolymer are preferably used in particular. The content of these substances is preferred to be 3 to 30 wt. % of the total solid content weight of the ink receiving layer. If less than 3 wt. %, fading preventive effect is insufficient, or if exceeding 30 wt. %, the strength of the printed portion of the ink receiving layer is insufficient. More preferably, the content is 5 to 25 wt. %.

In the ink receiving layer, aside from the above substances, it is preferred to contain a filler. As the filler, various known inorganic fillers and organic fillers can be used. Inorganic fillers include silica, calcium carbonate, diatom earth, and kaolin. Organic fillers include styrene and methacrylic acid beads. In particular, inorganic fillers are preferred, and silica is most suitable from the viewpoint of ink absorption.

The ink receiving layer may contain, aside from at least one of chlorinated polypropylene, compound of chlorinated polypropylene, versatic acid vinyl ester, and compound of versatic acid vinyl ester, and the filler, various known binders. As the binder, it is preferred to use a resin which does not dissolve or swell in the petroleum high boiling point solvent. When a resin which does not dissolve or swell in the petroleum high boiling point solvent is contained, the strength is increased in the printed portion of the ink receiving layer when printed in an oil-based ink. Examples of resin which does not dissolve or swell in the petroleum high boiling point solvent may be selected from ester acrylate copolymer resins and polyvinyl alcohols. In the ink receiving layer, the blending ratio of at least one of chlorinated polypropylene, compound of chlorinated polypropylene, versatic acid vinyl ester, and compound of versatic acid vinyl ester to the resin which does not dissolve or swell in the petroleum high boiling point solvent should be in a range of 7:3 to 1:9. In this range, both the fading preventive effect and the strength of the ink receiving layer are likely to be satisfied at the same time.

The ink receiving layer may also contain various additives as required, such as surface active agent, antistatic agent, and ultraviolet ray absorbent. The thickness of the ink receiving layer is preferably 10 to 60 μm. More preferably, it is 20 to 50 μm. The ink receiving layer can be formed on the base material by coating, spraying, immersing, etc. In the coating process, various known devices can be used, such as air knife coater, bar coater, and roll coater.

In the invention, an intermediate layer may be provided between the ink receiving layer and the base material. In particular, it is preferred to place an intermediate layer containing a resin which swells in the petroleum high boiling point solvent, or swells and then dissolves therein. By inserting such intermediate layer, the ink absorption of the enter ink jet recording sheet is enhanced when printed in an oil-based ink, and fixing of coloring material in the ink receiving layer is stronger. As a result, together with the effects of the ink receiving layer of the invention, an ink jet recording sheet particularly excellent in suitability to the oil-based ink is realized.

The intermediate layer is mainly composed of a binder resin, and further silica, titanium oxide or other filler may be added in order to enhance the blocking preventive property or opacity. The binder resin mainly composing the intermediate layer is preferred to be capable of absorbing and holding the petroleum high boiling point solvent used as the solvent for oil-based ink, and hence it is preferred to have a property of swelling in the petroleum high boiling point solvent, or swelling and then dissolving in the petroleum high boiling point solvent. The binder having such property, after being formed as the intermediate layer, only swells but does not dissolve in the amount of ink used in the ink jet recording condition. As such resin, for example, styrene resin and rubber resin may be used, and styrene resin alone, rubber resin alone, or their mixture at a proper rate may be used. The resins to be contained in the intermediate layer may include, aside from such styrene resin and rubber resin, acrylic resin, polyester resin, and urethane resin.

Examples of styrene resin include styrenic alkyd resin, styrene-acrylic copolymer resin, and their substituent derivatives. Substituent derivatives are, for example, carboxylated one and its alkaline reactive one.

Examples of rubber resin include styrene-butadiene copolymer resin, ester methacrylate-butadiene copolymer resin, urethane acrylate rubber, polynorbonene resin, and their substituent derivatives. Substituent derivatives are, for example, carboxylated one and its alkaline reactive one.

One or plural types of styrene resin and rubber resin may be mixed. Among the resins, in particular, styrene-butadiene copolymer resin and polynorbonene resin show excellent solubility in the petroleum high boiling point solvent, and exhibit a smooth swelling property in the solvent as intermediate layer. As the petroleum high boiling point solvent as the solvent for an oil-based ink, isoparaffin and paraffin are preferably used.

The thickness of the intermediate layer is about 1 to 10 μm, and more preferably about 2 to 8 μm, but the thickness may be properly adjusted in relation to the type of ink solvent and ink absorbing amount. Herein, the intermediate layer is composed of one layer only, but may be also composed of two or more layers by using one or two or more different resins selected from styrene resins and rubber resins.

The base material of the invention is not particularly specified, and plastic films, paper, synthetic paper, non-woven cloth and others may be used. In particular, plastic films are preferred from the viewpoint of resistance to water. Specific examples are general thermoplastic resin films such as polyethylene terephthalate, polypropylene, polystyrene, or polycarbonate, or those incorporating inorganic powder such as calcium carbonate, incorporating organic pigment, or forming voids in manufacturing process, white polyester film with glossy surface incorporating titanium oxide, transparent polypropylene film, and other light permeable plastic films. The thickness of the base material may be properly selected depending on the purpose, and usually it is about 50 to 250 μm. Or, to improve adhesion to the intermediate layer, or adhesion to the ink receiving layer if intermediate layer is not provided, the surface of the base material may be processed by anchor coating or corona discharge.

EXAMPLES

Exemplary examples of the invention are described below. It must be noted, however, that the invention is not limited to these examples alone. In the following description, meanwhile, the percentage refers to wt. %.

Example 1

The base material was a white polyester film of 100 μm in thickness, and an intermediate layer was formed on one side thereof by applying 100 parts by weight of styrene-butadiene copolymer resin (Tufprene 912 of ASAHI KASEI CORPORATION) dissolved in 400 parts by weight of toluene in a dry film thickness of 5 μm by means of reverse roll coater. To form an ink receiving layer, 18 parts by weight of denatured chlorinated polypropylene resin (Hardlen EH-202 of TOYO KASEI KOGYO CO., LTD., solid content 20%), 28 parts by weight of ester acrylate copolymer resin (NK POLYMER AC-117N of SHIN-NAKAMURA CHEMICAL CO., LTD., solid content 34%), and 16 parts by weight of synthetic silica (Sylysia 450 of Fuji Silysia Chemical) were sufficiently stirred, and dispersed in a sand grinder, and the obtained coating dispersion solution was applied on the intermediate layer in a dry film thickness of 50 μm by means of reverse roll coater, and the ink jet recording sheet of the invention was obtained. Tufprene 912 swells in the petroleum high boiling point solvent. NK POLYMER AC-117N neither dissolves nor swells in the petroleum high boiling point solvent.

Example 2

The base material was a white polyester film of 100 μm in thickness, and an intermediate layer was formed on one side thereof by applying 100 parts by weight of styrene-butadiene copolymer resin (Tufprene 912 of ASAHI KASEI CORPORATION) dissolved in 400 parts by weight of toluene in a dry film thickness of 5 μm by means of reverse roll coater. To form an ink receiving layer, 8 parts by weight of ethylene-vinyl acetate-versatic acid vinyl ester copolymer resin (SUMIKAFLEX 950 of Sumitomo Chemical Co. Ltd., solid content 53%), 36 parts by weight of ester acrylate copolymer resin (NK POLYMER AC-117N of SHIN-NAKAMURA CHEMICAL CO., LTD., solid content 34%), and 20 parts by weight of synthetic silica (Sylysia 450 of Fuji Silysia Chemical) were sufficiently stirred, and dispersed in a sand grinder, and the obtained coating dispersion solution was applied on the intermediate layer in a dry film thickness of 50 μm by means of reverse roll coater, and the ink jet recording sheet of the invention was obtained.

Example 3

The ink jet recording sheet of the invention was obtained in the same procedure as in example 1, except that styrene-alkylester acrylate copolymer resin (ACRONAL YJ-6221D of BASF Dispersion, solid content 49%) was applied in a dry film thickness of 5 μm by means of reverse roll coater, instead of the intermediate layer in example 1. ACRONAL YJ-6221D neither dissolves nor swells in the petroleum high boiling point solvent.

Comparative Example 1

The base material was a white polyester film of 100 μm in thickness, and an intermediate layer was formed on one side thereof by applying 100 parts by weight of styrene-butadiene copolymer resin (Tufprene 912 of ASAHI KASEI CORPORATION) dissolved in 400 parts by weight of toluene in a dry film thickness of 5 μm by means of reverse roll coater. To form an ink receiving layer, 40 parts by weight of ester acrylate copolymer resin (NK POLYMER AC-117N of SHIN-NAKAMURA CHEMICAL CO., LTD., solid content 34%), and 17 parts by weight of synthetic silica (Sylysia 450 of Fuji Silysia Chemical) were sufficiently stirred, and dispersed in a sand grinder, and the obtained coating dispersion solution was applied on the intermediate layer in a dry film thickness of 50 μm by means of reverse roll coater, and an ink jet recording sheet was obtained.

Comparative Example 2

An ink jet recording sheet was obtained in the same procedure as in example 1, except that 8 parts by weight of polyurethane resin (SUPERFLEX E-4000 of Dai-ichi Kogyo Seiyaku Co., Ltd., solid content 45%) was used instead of 18 parts by weight of denatured chlorinated polypropylene resin (Hardlen EH-202 of TOYO KASEI KOGYO CO., LTD., solid content 20%). SUPERFLEX E-4000 dissolves and/or swells in the petroleum high boiling point solvent. Its degree is smaller as compared with Hardlen EH-202. Its property of fixing the coloring material in the ink is also smaller as compared with Hardlen EH-202.

The ink jet recording sheets obtained in these examples 1, 2, 3, and comparative examples 1 and 2 were evaluated in the following methods.

Methods of Evaluation (1) Fading

Using a commercial ink jet printer, 8 colors were printed by oil-based inks, that is, black, cyan, magenta, yellow, magenta+yellow, magenta+cyan, cyan+yellow, and magenta +cyan+yellow, and the reflection density of the ink receiving layer side was measured by using MacBeth reflection densitometer RD-918, right after printing (X value) and 72 hours later (Y value). The ratio Y/X was calculated, and the degree of fading was evaluated. Results of examples 1 to 3 are shown in Tables 1 to 3, and results of comparative examples 1 and 2 are given in Tables 4 and 5.

(2) Bleeding of ink

Oil-based inks (cyan, magenta, and yellow) were overprinted by using a commercial ink jet printer, and bleeding of inks was visually evaluated in the surrounding of the overprinted portion 24 hours later. Results are shown in Table 6.

TABLE 1

(Example 1)

| | Black | Cyan | Magenta | Yellow | Magenta + yellow | Magenta + cyan | Cyan + yellow | Magenta + cyan + yellow |
|---|---|---|---|---|---|---|---|---|
| 72 hours later (Y) | 1.25 | 1.12 | 1.07 | 1.12 | 1.04 | 1.07 | 0.57 | 1.12 |
| Right after (X) | 1.26 | 1.16 | 1.11 | 1.14 | 1.13 | 1.18 | 0.67 | 1.41 |
| Y/X | 0.99 | 0.97 | 0.96 | 0.98 | 0.92 | 0.91 | 0.85 | 0.79 |

TABLE 2

(Example 2)

| | Black | Cyan | Magenta | Yellow | Magenta + yellow | Magenta + cyan | Cyan + yellow | Magenta + cyan + yellow |
|---|---|---|---|---|---|---|---|---|
| 72 hours later (Y) | 1.25 | 1.13 | 1.05 | 1.15 | 1.00 | 1.07 | 0.57 | 1.07 |
| Right after (X) | 1.27 | 1.18 | 1.10 | 1.17 | 1.09 | 1.15 | 0.64 | 1.23 |
| Y/X | 0.98 | 0.96 | 0.95 | 0.98 | 0.92 | 0.93 | 0.89 | 0.87 |

TABLE 3

(Example 3)

| | Black | Cyan | Magenta | Yellow | Magenta + yellow | Magenta + cyan | Cyan + yellow | Magenta + cyan + yellow |
|---|---|---|---|---|---|---|---|---|
| 72 hours later (Y) | 1.27 | 1.14 | 1.08 | 1.12 | 1.09 | 1.07 | 0.58 | 1.10 |
| Right after (X) | 1.28 | 1.18 | 1.11 | 1.16 | 1.14 | 1.18 | 0.69 | 1.46 |
| Y/X | 0.99 | 0.97 | 0.97 | 0.97 | 0.96 | 0.91 | 0.84 | 0.75 |

TABLE 4

(Comparative example 1)

| | Black | Cyan | Magenta | Yellow | Magenta + yellow | Magenta + cyan | Cyan + yellow | Magenta + cyan + yellow |
|---|---|---|---|---|---|---|---|---|
| 72 hours later (Y) | 1.25 | 1.11 | 1.00 | 1.10 | 0.38 | 0.93 | 0.51 | 0.98 |
| Right after (X) | 1.30 | 1.16 | 1.08 | 1.16 | 1.13 | 1.18 | 0.70 | 1.43 |
| Y/X | 0.96 | 0.96 | 0.93 | 0.95 | 0.78 | 0.79 | 0.73 | 0.69 |

TABLE 5

(Comparative example 2)

| | Black | Cyan | Magenta | Yellow | Magenta + yellow | Magenta + cyan | Cyan + yellow | Magenta + cyan + yellow |
|---|---|---|---|---|---|---|---|---|
| 72 hours later (Y) | 1.25 | 1.16 | 1.06 | 1.11 | 0.97 | 1.01 | 0.54 | 0.93 |
| Right after (X) | 1.26 | 1.18 | 1.09 | 1.14 | 1.11 | 1.10 | 0.62 | 1.35 |
| Y/X | 0.99 | 0.98 | 0.97 | 0.97 | 0.87 | 0.92 | 0.87 | 0.69 |

TABLE 6

| | Example 1 | Example 2 | Example 3 | Comparative example 1 | Comparative example 2 |
|---|---|---|---|---|---|
| (1) Bleeding of ink (Note) | ○ | ○ | Δ | ○ | ○ |

(Note) ○: no bleed of ink, Δ: slight bleed of ink

As compared with comparative example 1, fading was slightly less in comparative example 2, but fading preventive effect was insufficient. In examples 1 to 3, as compared with comparative examples 1 and 2, fading was slight, and an excellent fading preventive effect was recognized. In particular, a notable difference was observed in magenta, two-color, and three-color printing (see Tables 1 to 5).

It was also confirmed that examples 1 and 2 also had the bleed suppressing property (see Table 6).

As described herein, according to the ink jet recording sheet of the invention, excellent properties were obtained not only in the image quality right after printing by oil-based ink, but also in fading preventive effect, that is, less fading after a certain time, and hence it brings about an outstanding effect of sufficiently satisfying the recent demand for long-term stability in ink jet recording sheets.

What is claimed is:

1. An ink jet recording sheet forming an ink receiving layer on a base material, wherein the ink receiving layer contains at least one of chlorinated polypropylene, and compound of chlorinated polypropylene.

2. An inkjet recording sheet of claim 1, wherein the ink receiving layer contains a resin which does not dissolve or swell in a petroleum high boiling point solvent in an oil-based ink.

3. An ink jet recording sheet of claim 1, wherein an intermediate layer containing a resin capable of absorbing and holding a petroleum high boiling point solvent in an oil-based ink is provided between the ink receiving layer and the base material.

4. An inkjet recording sheet of claim 2, wherein an intermediate layer containing a resin capable of absorbing and holding a petroleum high boiling point solvent in an oil-based ink is provided between the ink receiving layer and the base material.

5. An ink jet recording sheet of claim 3, wherein the resin capable of absorbing and holding a petroleum high boiling point solvent in an oil-based ink is a resin swelling in the solvent, or swelling and then dissolving therein.

6. An ink jet recording sheet of claim 4, wherein the resin capable of absorbing and holding a petroleum high boiling point solvent in an oil-based ink is a resin swelling in the solvent, or swelling and then dissolving therein.

7. The ink jet recording sheet of claim 1, wherein said ink receiving layer further contains a copolymer of versatic acid vinyl.

8. An ink jet recording sheet of claim 7, wherein the ink receiving layer contains a resin which does not dissolve or swell in a petroleum high boiling point solvent in an oil-based ink.

9. An ink jet recording sheet of claim 7, wherein an intermediate layer containing a resin capable of absorbing and holding a petroleum high boiling point solvent in an oil-based ink is provided between the ink receiving layer and the base material.

10. An ink jet recording sheet of claim 8, wherein an intermediate layer containing a resin capable of absorbing and holding a petroleum high boiling point solvent in an oil-based ink is provided between the ink receiving layer and the base material.

11. An ink jet recording sheet of claim 9, wherein the resin capable of absorbing and holding a petroleum high boiling point solvent in an oil-based ink is a resin swelling in the solvent, or swelling and then dissolving therein.

12. An ink jet recording sheet of claim 10, wherein the resin capable of absorbing and holding a petroleum high boiling point solvent in an oil-based ink is a resin swelling in the solvent, or swelling and then dissolving therein.

13. The ink jet recording sheet of claim 1, wherein said wherein said ink receiving layer further contains a homopolymer of versatic acid vinyl.

14. An ink jet recording sheet of claim 13, wherein the ink receiving layer contains a resin which does not dissolve or swell in a petroleum high boiling point solvent in an oil-based ink.

15. An ink jet recording sheet of claim 13, wherein an intermediate layer containing a resin capable of absorbing and holding a petroleum high boiling point solvent in an oil-based ink is provided between the ink receiving layer and the base material.

16. An ink jet recording sheet of claim 14, wherein an intermediate layer containing a resin capable of absorbing and holding a petroleum high boiling point solvent in an oil-based ink is provided between the ink receiving layer and the base material.

17. An ink jet recording sheet of claim 15, wherein the resin capable of absorbing and holding a petroleum high boiling point solvent in an oil-based ink is a resin swelling in the solvent, or swelling and then dissolving therein.

18. An ink jet recording sheet of claim 16, wherein the resin capable of absorbing and holding a petroleum high boiling point solvent in an oil-based ink is a resin swelling in the solvent, or swelling and then dissolving therein.

* * * * *